US007743546B2

(12) United States Patent
Keng

(10) Patent No.: US 7,743,546 B2
(45) Date of Patent: Jun. 29, 2010

(54) FIREARM ADAPTED FOR USE IN LOW LIGHT, ILLUMINATING REAR SIGHT, AND METHOD FOR ALIGNING SIGHTS IN LOW LIGHT ENVIRONMENTS

(76) Inventor: Da Keng, 875 Wharton Dr. SW., Smyrna, GA (US) 30336

( * ) Notice: Subject to any disclaimer, the term of this patent is extended or adjusted under 35 U.S.C. 154(b) by 1004 days.

(21) Appl. No.: 11/341,606

(22) Filed: Jan. 30, 2006

(65) Prior Publication Data

US 2006/0207157 A1 Sep. 21, 2006

Related U.S. Application Data

(60) Provisional application No. 60/647,402, filed on Jan. 28, 2005.

(51) Int. Cl.
*F41G 1/01* (2006.01)

(52) U.S. Cl. ..... 42/145; 42/113; 42/132

(58) Field of Classification Search ..... 42/144, 42/145, 113, 132
See application file for complete search history.

(56) References Cited

U.S. PATENT DOCUMENTS

| | | | | |
|---|---|---|---|---|
| 837,563 | A * | 12/1906 | Hartmann | 42/144 |
| 3,641,676 | A * | 2/1972 | Knutsen et al. | 42/136 |
| 5,359,800 | A * | 11/1994 | Fisher et al. | 42/145 |
| 6,978,569 | B2 * | 12/2005 | Williamson et al. | 42/132 |

* cited by examiner

*Primary Examiner*—Stephen M Johnson
(74) *Attorney, Agent, or Firm*—J. A. McKinney, Jr.

(57) ABSTRACT

A rugged adjustable, optical alignment system is well suited for use in low light environments or at night. A rear sight includes a U-shaped array of, preferably, first second and third substantially cylindrical, transparent, tritium vials arranged such that the elongated cylindrical side surfaces of the vials are exposed to define an array of elongated illuminated segments. The array is preferably in the shape of a "U" having a first horizontally aligned vial positioned below a sight notch with a second vertical vial positioned above and to the left of the notch. A third vertical vial is positioned to the right of the sighting notch, above the first vial. In use, a front blade or front post also containing a tritium insert is aligned within the rear sight's U-shaped array of illuminated segments, thereby providing an intuitive sight picture.

19 Claims, 7 Drawing Sheets

16
52
78
80
76
66
74

16
58
66
UP 16
54
32
50
LEFT
66
56

16
52
50
LEFT
58
56
66
74
76
78

16
66
50
42
70
40
54
32

FIREARM ADAPTED FOR USE IN LOW LIGHT, ILLUMINATING REAR SIGHT, AND METHOD FOR ALIGNING SIGHTS IN LOW LIGHT ENVIRONMENTS

RELATED PATENT APPLICATION AND PRIORITY CLAIM INFORMATION

This application claims priority to co-pending provisional application number 60/647,402, filed Jan. 28, 2005, the entire disclosure of which is incorporated herein by reference.

BACKGROUND OF THE INVENTION

1. Field of the Invention

The present invention relates to an optical alignment device such as a firearm sight adapted for use in low light and a method for mounting and adjusting optical devices such as gun sights on pistols or other firearms when operating in low light environments.

2. Discussion of the Prior Art

At present, a wide variety of optical sights are available for use on firearms such as handguns or pistols. A typical pistol has optical alignment fixtures or sights including a front sight and a rear sight that can be aligned with one another to form a sight picture for aligning the pistol's point of aim on the target. Prior art pistol sights are usually mounted along the top edge of the pistol. Traditional semi-automatic pistols (such as the well known Colt™ model 1911, caliber .45) include a grip or handle carrying a lower receiver and a trigger mechanism and a slide member is slidably supported on the lower receiver.

The traditional front sight is a vertically projecting blade or ramp-like member mounted at the front of the slide and the rear sight is adapted for mounting to the rear of the slide using a dovetailed transverse protrusion that mates with a corresponding transverse dovetailed slot in the slide.

Police officers and members of the military require especially rugged sights on their weapons and so a genre of firearms and accessories adapted for "combat carry" has evolved to serve their special needs.

The applicant developed a fixed sight intended to provide a smooth and snag-free draw, a clear sight picture and rugged service; the fixed sight is shown in Design Patent D447,205. Others, including gunsmith Wayne Novak, have also developed a number of designs for sights intended to provide rugged service, and such sights are often fitted in a transverse dovetailed notch having standardized dimensions known in the industry as the "Novak notch" dimensions. By transverse is meant in a direction at a right angle to the pistol bore and lying in a horizontal plane when the pistol is held in a standard grip with the bore centerline in a horizontal plane. Generally, the standardized dimensions for the notch will accept a dovetail-like projection that is 12.5 millimeters (mm) in fore-aft length on a planar bottom surface and tapers inwardly at 70 degrees from horizontal on front and back wall surfaces; the bottom planar surface of the projection is preferably 3 mm in vertical height from the upper surface of the notch opening, within customary gunsmithing tolerances.

While the combat sights of the prior art do provide a smooth and snag-free draw, a clear sight picture and rugged service, they do not provide the adjustability many have come to enjoy when using target pistols equipped with adjustable target sights. Prior art sights also require plenty of ambient light around the target and on the sights themselves and so are not well suited for use in low light or at night. Often, when shooting in low light, there are two difficulties. First, it is difficult to identify the target and distinguish the target from the background or from any other clutter in the field of view. Secondly, it is difficult when trying to keep the target in view to also properly align the sights in what is commonly referred to as an appropriate "sight picture."

Prior art firearms for use in a low light environment, in a firefight, often included attached tactical flashlights or the like. When confronting a mobile, armed opponent, it may be undesirable to give away a user's location by attempting to illuminate the opponent with the flashlight. To the opponent, that flashlight may serve as a beacon and give the opponent a target that is easy to find.

There has been a long felt need, then, for a firearm with a simple and reliable sight system adapted for use in low light or at night.

OBJECTS AND SUMMARY OF THE INVENTION

Accordingly, it is a primary object of the present invention to overcome the above mentioned difficulties by providing a pistol or other firearm with a simple and reliable sight system adapted for use in low light or at night.

Another object of the present invention is providing an optical alignment device permitting a clear sight picture in low light or at night.

The aforesaid objects are achieved individually and in combination, and it is not intended that the present invention be construed as requiring two or more of the objects to be combined unless expressly required by the claims attached hereto.

Broadly speaking, the present invention includes a firearm adapted for use in low light or at night. Often, when shooting in low light, there are two difficulties. First, it is difficult to identify the target and distinguish the target from the background or from any other clutter in the field of view. Secondly, it is difficult when trying to keep the target in view to also properly align the sights in what is commonly referred to as an appropriate "sight picture."

In accordance with the method of the present invention, a rear sight includes a U-shaped array of, preferably, first, second and third substantially cylindrical, transparent, tritium vials arranged such that the elongated cylindrical side surfaces of the vials are exposed to define an array of elongated illuminated segments. The array is preferably in the shape of a "U" having a first horizontally aligned vial positioned below a sight notch with a second vertical vial positioned above and to the left of the notch. A third vertical vial is positioned to the right of the sighting notch, above the first vial. Preferably, the central axis of the third vial is substantially perpendicular to the central axis of the first vial, and substantially parallel with the central axis of the second vial.

In use, a front blade or front post also containing a tritium insert is aligned within the rear sight's U-shaped array of illuminated segments, thereby providing an intuitive sight picture. Shooters are readily trained to use the firearm of the present invention when shooting in low light and in accordance with the method of the present invention, the shooter is simply instructed to "put the ball in the bucket" where the ball, in this instance, represents the front post's round illuminating tritium insert and the "bucket" represents the U-shaped array of illuminating tritium vials surrounding the rear sight notch.

The firearm of the present invention is particularly well suited for use in configuration with a sight radius relatively short. Pistols, for example typically have a sight radius of between 3 and 10 inches. Tactical shot guns and other firearms used by police forces and military forces have a relatively short sight radius, typically between 14 and 20 inches.

The firearm of the present invention is particularly well suited for use in low light and is substantially safer in a firefight when compared to use of tactical flash lights in the like. When confronting a mobile armed subject, it may be undesirable to identify a user's location by attempting to illuminate the target with a flashlight. That flashlight essentially serves as a beacon and gives an armed opponent a target that is easy to find.

In a second embodiment of the present invention, a kit of sights especially adapted for attachment to a firearm can be retrofitted to the firearm thereby adapting that firearm for use in low light. The kit preferably includes a matched set of rear sight and front sight members where the rear sight includes the U shaped array of tritium vials and the front sight includes a tritium insert sized to provide and intuitive sight picture so that, in accordance with the method of the present invention, a shooter can be trained to put the ball in the bucket. Thereby appropriately aligning the front sights tritium insert in the center of the notch within the U shaped array of tritium vials including the rear sight.

In one embodiment, the sight assembly of the present invention is an adjustable rear sight for a pistol, and is also adapted to be received within an oversized dovetail Novak-style notch in the pistol slide, in accordance with standard industry practice.

The sight system of the present invention preferably includes a pistol slide or firearm receiver having a transverse notch. As above, "transverse" means in a left-right direction at a right angle to the firearm's bore and lying in a substantially horizontal plane when the firearm is positioned with the bore centerline in a horizontal plane. Generally, the standardized dimensions for the notch will accept a Novak-style dovetail-like projection that is, in the exemplary embodiment, 12.5 millimeters (mm) in fore-aft length on a substantially planar bottom surface and tapers inwardly at 70 degrees from horizontal on front and back wall surfaces; the bottom planar surface of the projection is preferably 3 mm in vertical height from the upper surface of the notch opening, within customary gunsmithing tolerances. The transverse notch bottom surface preferably includes a substantially ovoid transversely elongated detent or indentation having a first substantially vertical closed end wall opposite a second substantially vertical end wall. The indentation's second end wall defines an open segment that provides access to the interior of the indentation from the side of the pistol slide or firearm receiver.

The sight base is dimensioned to slidably engage the transverse notch and carries, in the exemplary embodiment, a dovetail projection that is 12.5 millimeters (mm) in fore-aft length on a planar bottom surface and tapers inwardly at 70 degrees from horizontal on front and back wall surfaces; the bottom planar surface of the dovetail projection is preferably 3 mm in vertical height from the upper surface of the notch opening, within customary gunsmithing tolerances.

The dovetail projection's bottom surface preferably carries a substantially ovoid transversely elongated tempered steel leaf spring biased locking member having a first substantially vertical proximal end surface (dimensioned to engage and abut the indentation's first closed end wall) opposite a second substantially vertical distal end surface (dimensioned to releasably engage and abut the indentation's second end wall). The leaf spring biased locking member is preferably pinned or fastened to the dovetail's bottom surface.

Preferably, dovetail projection's bottom surface includes a substantially ovoid transversely elongated indentation having a first substantially vertical closed end wall opposite a second substantially vertical end wall. The dovetail's indentation second end wall defines an open segment that provides access to the interior of the indentation from the side of the dovetail projection and the dovetail's indentation has a sidewall vertical extent (or depth) that substantially equals the thickness of the leaf spring biased locking member so that the leaf spring locking member can be forced against the dovetail bottom surface and completely into the dovetail indentation, so as to completely disengage the leaf spring biased locking member from the firearm receiver's transverse notch.

In use, the sight base dovetail projection carrying the leaf spring member is inserted into the side opening of the firearm receiver's transverse notch with the pinned end of the leaf spring locking member sliding transversely over the receiver indentation's second end wall open segment (at the side of the pistol slide or firearm receiver). The user slides the sight base toward the bore's center axis to its fullest transverse extent, whereupon the leaf spring locking member's vertical pinned end surface rigidly engages and abuts the indentation's first closed end wall. At this moment, the leaf spring locking member's free distal end springs down and the locking member's vertical distal end surface releasably engages and abuts the indentation's second end wall, thus releasably locking the sight base to the receiver (or pistol slide).

The free, distal end of the leaf spring locking member preferably carries a transversely projecting tab or extension that projects laterally out through the receiver indentation's side wall opening, so that a user can force a ramp-shaped tool end or screwdriver blade tip against a camming surface on the receiver to force the free, distal end of the leaf spring locking member up and away from the indentation's second end wall, thus releasing the sight base from fixed engagement with the receiver. Once the leaf spring locking member has been disengaged or unlocked, the user may slide the sight base transversely in the receiver's notch toward and over the receiver indentation's second end wall open segment (at the side of the pistol slide or firearm receiver).

Preferably, the receiver side wall includes a spherical indentation to provide the receiver camming surface proximate the indentation's second end wall open segment. A spherical indentation near the indentation's open wall segment permits the leaf spring locking member's transversely projecting tab to project toward the side of the receiver and permits a user to use a pointed bullet end, knife or awl when forcing the free, distal end of the leaf spring locking member up to unlock the sight base.

The leaf spring locking member is preferably retained in the dovetail projection by sliding the spring member into grooves in the dovetail indentation's first sidewall. A through-hole in the spring member receives a flanged leaf spring member retaining pin that is held captive by a perpendicular keeper pin peened in place after the leaf spring locking member distal end and flanged retaining pin are positioned in the dovetail indentation proximate the dovetail indentation's first sidewall.

The sight system of the present invention may optionally include a kit having several front sights and several rear sights, all having leaf spring locking members adapted to releasably engage the receiver's transverse groove and indentation. The sights may be of different mechanical configuration (e.g., taller to project above the bore centerline, for use when sighting over a suppressor) or may be similar but vary to move the point of impact up, down, left or right for a given point of aim, so a user can select an appropriate sight from a selection of sights provided in a kit with a firearm.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Referring now to FIGS. 1 through 8 of the accompanying drawings, the firearm and interchangeable sight system 10 of the present invention preferably includes a pistol slide or firearm receiver 12 having a transverse receiving notch 30. As above, "transverse" means in a left-right direction at a right angle to the pistol bore's central axis and lying in a horizontal plane when the pistol is held in a standard upright grip with the bore central axis in a horizontal plane.

Figure 1:
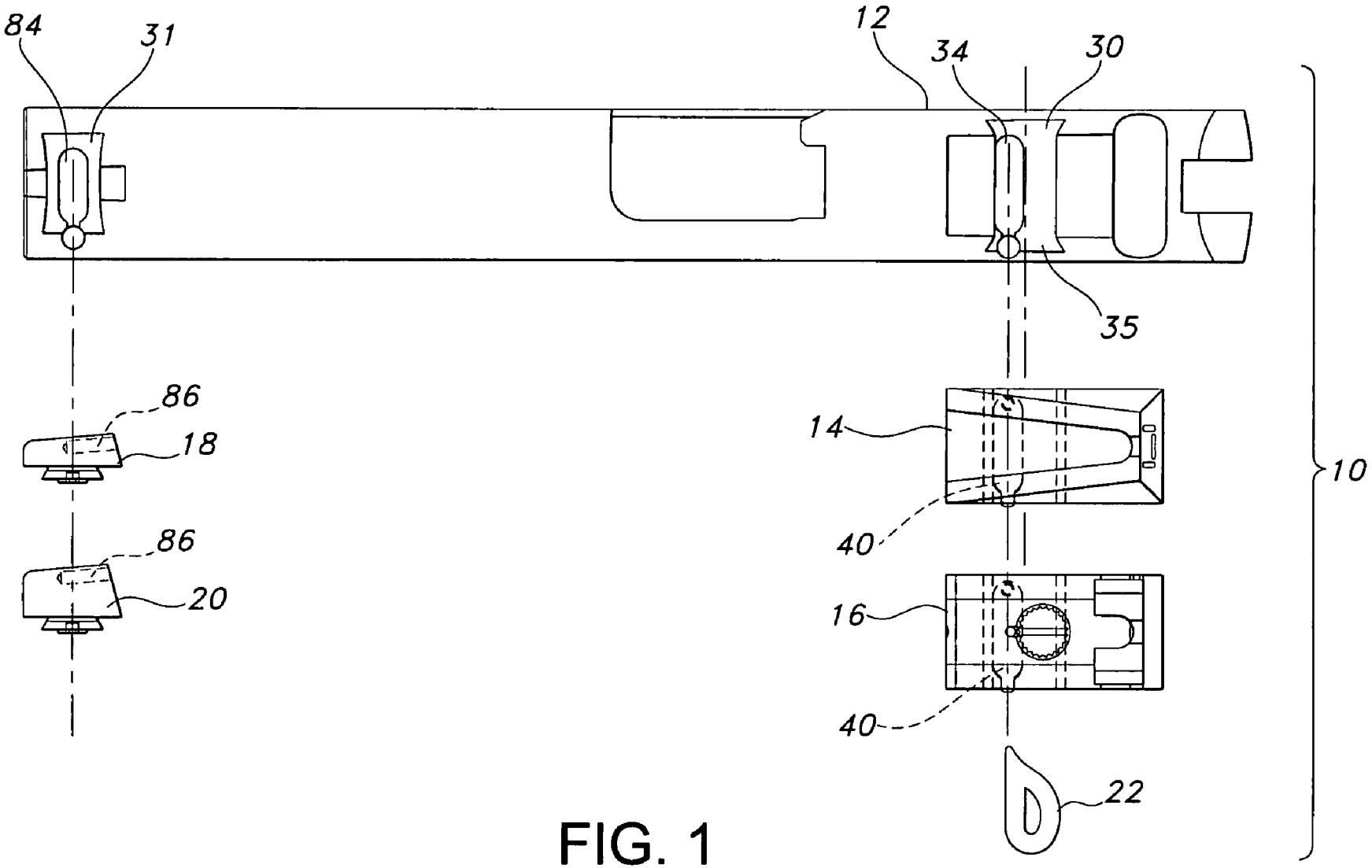
FIG. 1 is an exploded view of an interchangeable sight system, in accordance with the present invention.

As best seen in FIG. 1, sight system 10 can be embodied as a kit including a plurality of rear sights (e.g., fixed rear sight 14 and adjustable rear sight 16) and a plurality of front sights (e.g., a short front blade 18 and a taller front blade 20), as well as a sight unlocking/removal tool 22.

Figure 4B:
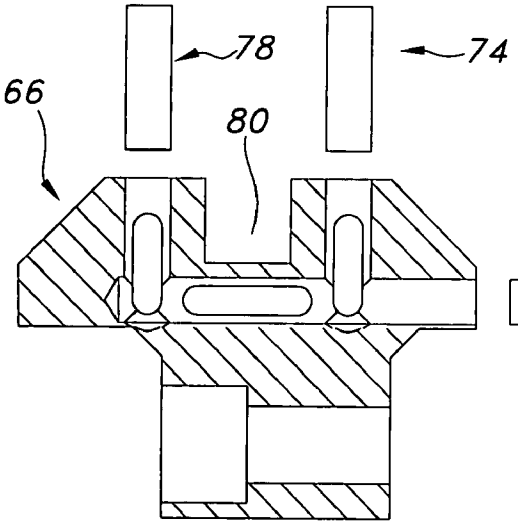
FIGS. 4*a*-4*e* illustrate five views of the low-light blade with the U-shaped array of elongate tritium vials defining a U-bracket around the rear sight notch of FIGS. 2 and 3, in accordance with the present invention.
Figure 4A:
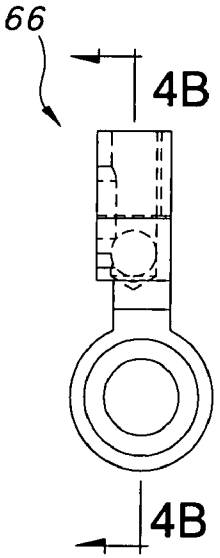
Figure 4C:
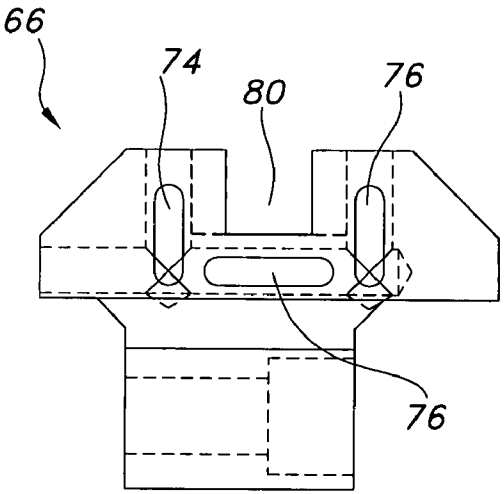
Figure 4D:
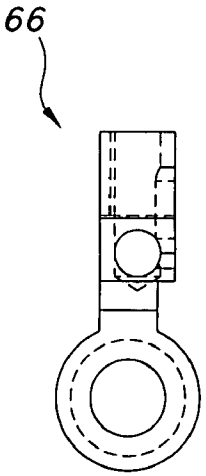
Figure 4E:
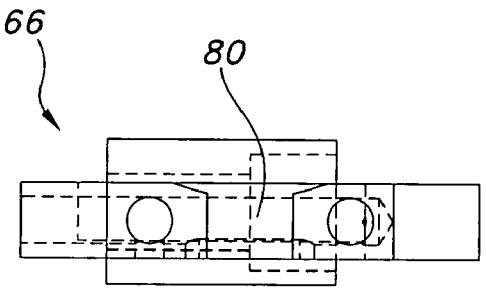
Figure 5D:
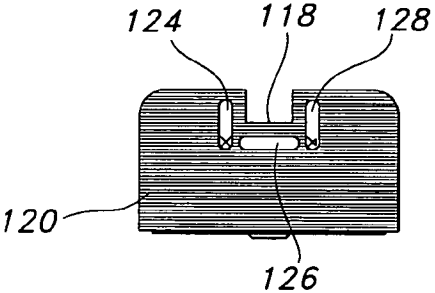
FIGS. 5*a*-5*e* illustrate five views of a second embodiment of the low-light rear sight assembly including a U-shaped array of elongate tritium vials defining a U-bracket around the rear sight notch, in accordance with the present invention.
Figure 5E:
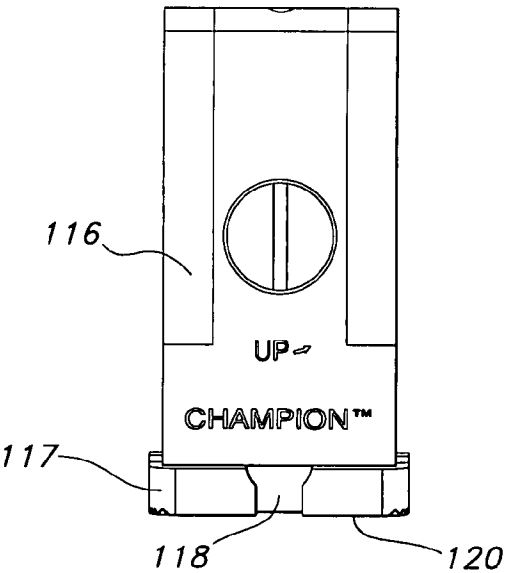
Figure 5A:
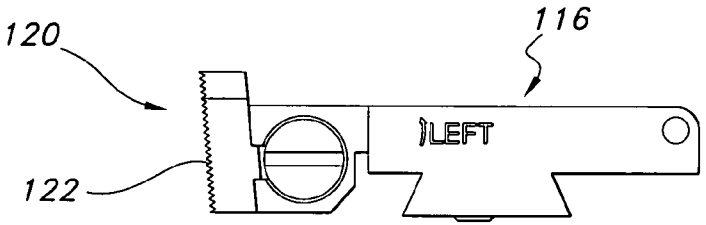
Figure 5B:
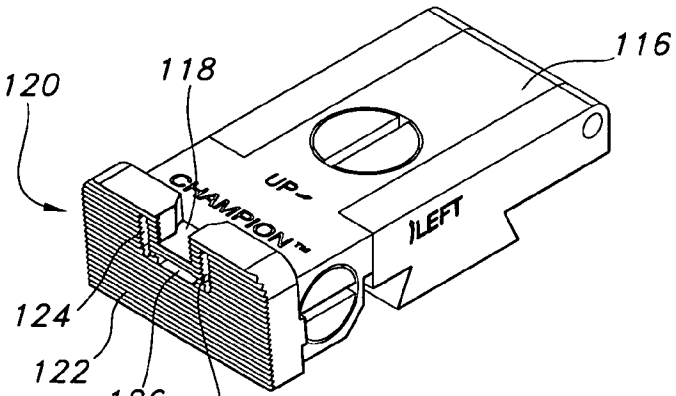
Figure 5C:
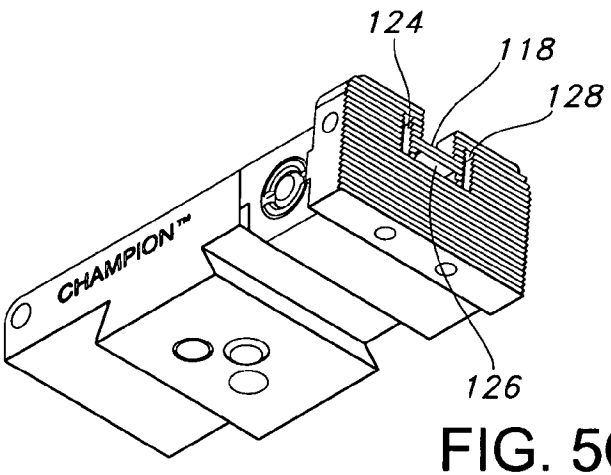
Figure 6G:
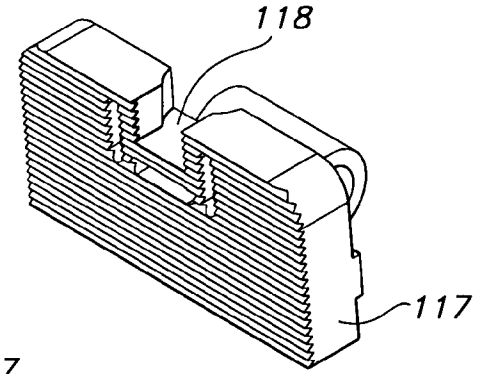
FIGS. 6*a*-6*g* illustrate six views of the low-light blade with the U-shaped array of elongate tritium vials defining a U-bracket around the rear sight notch of FIGS. 5*a*-5*e*, in accordance with the present invention.
Figure 6F:
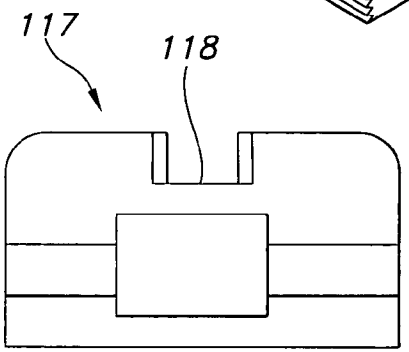
Figure 6E:
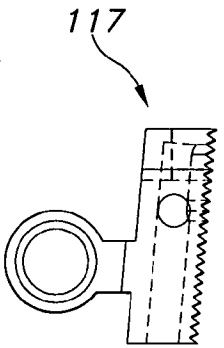
Figure 6A:
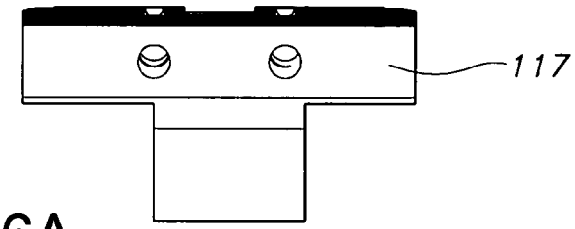
Figure 6C:
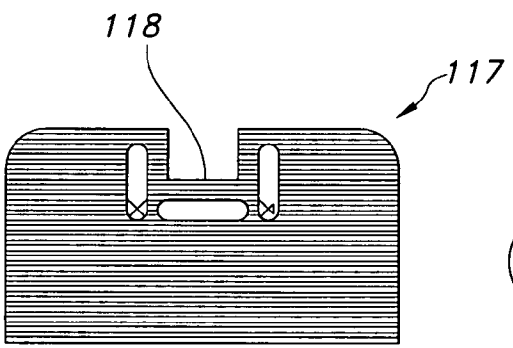
Figure 6D:
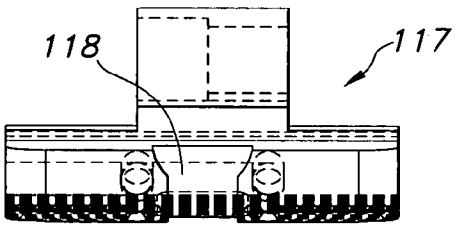
Figure 6B:
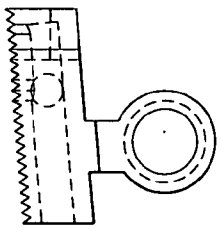

Generally, the standardized dimensions for receiving notch 30 (as best seen in FIGS. 1, 4*a* and 4*b*) define a configuration adapted to accept a Novak-style dovetail-like sight projection 32 (best seen in FIGS. 3A and 3C) and so, in the exemplary embodiment, notch 30 is 12.5 millimeters (mm) in fore-aft length along a substantially planar bottom surface 35 and tapers inwardly at seventy degrees from horizontal on front and back wall surfaces; the bottom planar surface 35 of the dovetail shaped receiving notch 30 is preferably three millimeters in vertical height from the bottom surface 35 to the notch's upward facing gap or opening.

The receiving notch's substantially planar bottom surface 35 preferably includes a substantially ovoid transversely elongated detent or indentation 34 configured to slidably receive and releasably engage a locking leaf spring member 40 carried on either of the interchangeable sights' dovetail projections.

The exemplary embodiment of the low light sight system is mountable upon a pistol slide or firearm receiver having a transverse notch. As above, "transverse" means in a left-right direction at a right angle to the firearm's bore and lying in a substantially horizontal plane when the firearm is positioned with the bore centerline in a horizontal plane. Generally, the standardized dimensions for the notch will accept a Novak-style dovetail-like projection.

The interchangeable sight system of the present invention may optionally include a kit having several front sights (e.g., 18, 20 and others) and several rear sights (e.g., 14,16 and others), all having leaf spring locking members (e.g., 40) adapted to releasably engage the firearm receiver's transverse groove (e.g., 30) and the ovoid indentation therein (e.g., 34). The sights may be of different mechanical configuration (e.g., taller to project above the bore centerline, for use when sighting over a suppressor) or may be similar but vary to move the point of impact up, down, left or right for a given point of aim, so a user can select an appropriate sight from a selection of sights provided in a kit with a firearm (e.g., 12).

Figure 2:
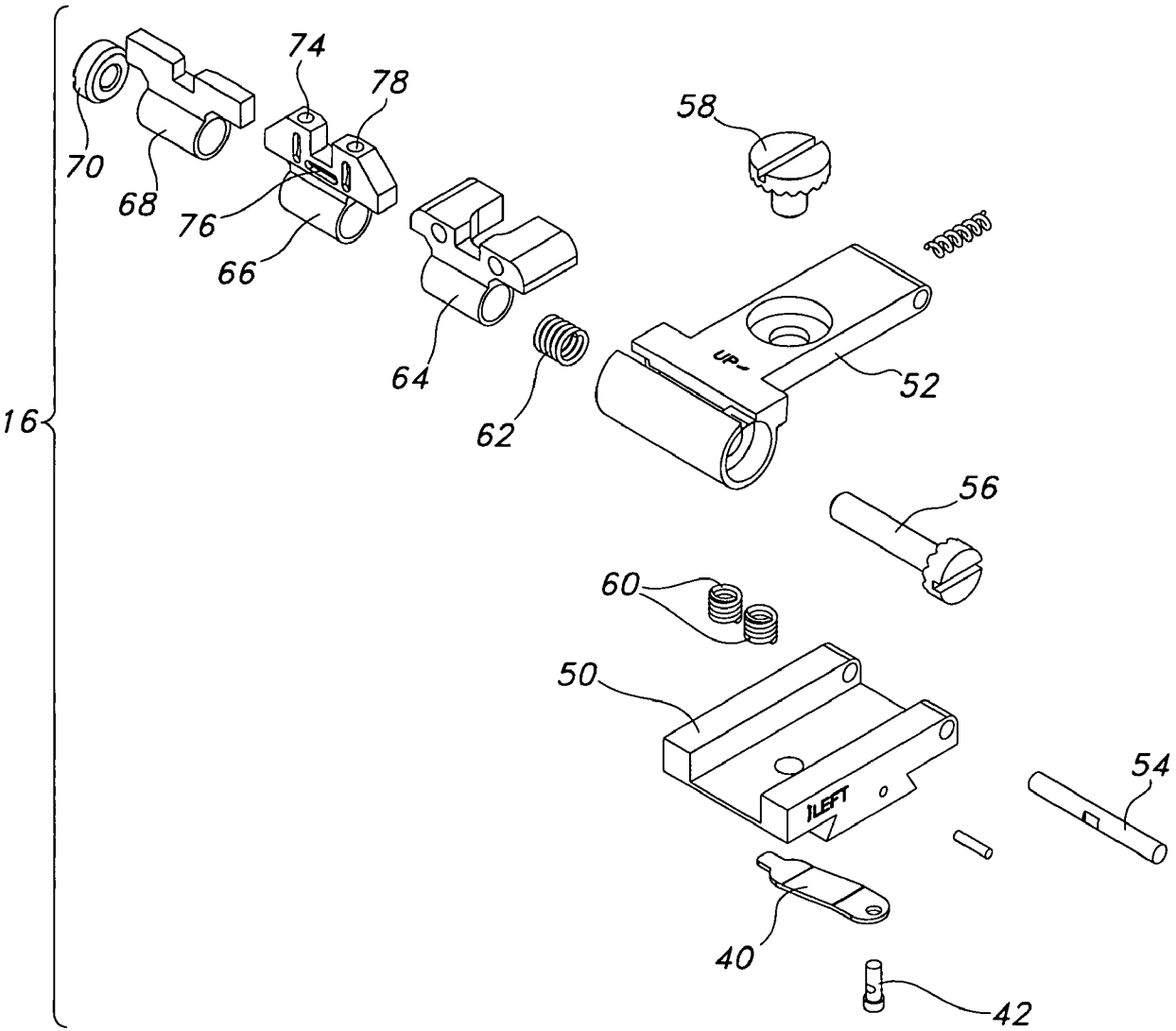
FIG. 2 is an exploded perspective view of an interchangeable low-light rear sight assembly showing the alternative selections for the rear notch, in accordance with the present invention.
Figures 3A, 3B, 3C, 3D, 3E:
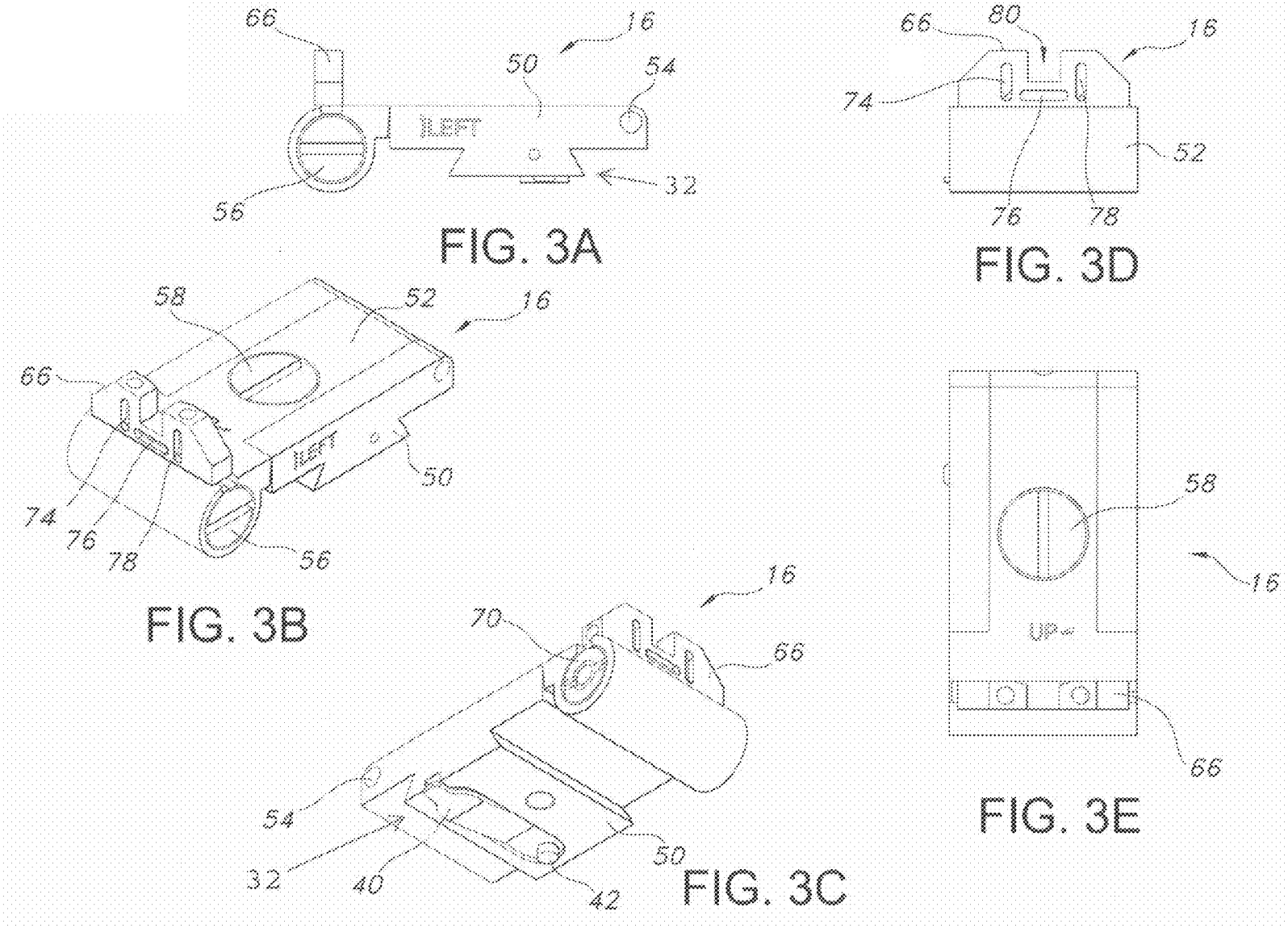
FIGS. 3*a*-3*e* illustrate five views of the low-light rear sight assembly of FIG. 2 carrying the blade including with the U-shaped array of elongate tritium vials defining a U-bracket around the rear sight notch, in accordance with the present invention.

In an exemplary embodiment for adjustable rear pistol sight assembly 16, as best seen in the exploded view of FIG. 2, and the views of FIGS. 3*a*-3*e*, a rear sight base 50 has an upper surface defining a longitudinal trough adapted to receive a hinged vertical swing that is rotatably pinned by a distally or forwardly carried transversely aligned hinge pin 54. Vertical swing is movable in the vertical or elevation direction at its proximal or rear end to adjustably vary the orientation of a selected rear sight aiming notch, as defined by one of a plurality of notch defining rear sight blades (e.g., 64, 66, 68) which are optionally included in a kit to permit the user to select a desired sight picture.

The elevation adjustment of rear sight assembly 16 is controlled using a threaded fastener or elevation adjustment screw 58 which limits the upward travel of vertical swing 52 when forced upwardly by one or more elevation position bias springs 60.

The windage or lateral adjustment of the rear sight notch is controlled using a second threaded fastener or windage adjustment screw 56 which limits the lateral or transverse travel of rear sight notch defining blase (e.g., 66) when forced laterally by one or more windage position bias springs 62 and the distal end of windage adjustment screw 56 is captured using a threaded nut fastener 70 to limit transverse travel of the selected rear sight blade in the transverse carrying slot defined in the proximal or rear end of vertical swing 52.

The rear sight assembly 16 of the embodiment illustrated in FIG. 2 includes a kit containing three possible selections for the rear sight notch defining blade member, namely:

(1) a two dot night sight blade 64, preferably containing tritium vials whose circular end surfaces are arrayed on either side of the notch, (2) the U-bracket night sight blade 66, preferably containing three cylindrical tritium vials, where the first two vials' elongate side surfaces are arrayed vertically on either side of the notch and the third vial's elongate side surface is aligned horizontally and centered beneath the notch, and (3) a plain notch rear sight blade 64.

The preferred configuration for low-light rear sight assembly 16, as best seen in FIGS. 3*a*-3*e*, includes blade 66 carrying a U-shaped array of three elongate cylindrical tritium vials 74, 76, 78 defining a U-bracket around the rear sight notch 80, and FIGS. 4*a*-4*e*illustrate low-light blade 66 with the U-shaped array of elongate tritium vials 74, 76 and 78 defining a U-bracket around the rear sight notch 80. While tritium vials are used in this illustrative embodiment, any light source providing three elongate lighted regions around notch 80 using, for example, light emitting diodes (LEDs) would also provide the advantageous sight picture of the present invention.

Figure 8:
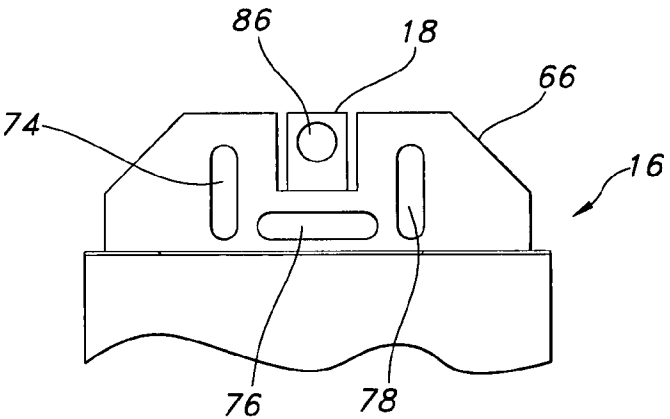
FIG. 8 illustrates a 'shooter's eye' view of the low-light front sight system of FIGS. 1, 2, 3 and 5 showing the instinctive "ball in a bucket" sight alignment method, wherein the "ball" of the front sight of FIG. 7 is aligned to appear to be inside the "bucket" of the U-bracket around the rear sight notch of FIGS. 2 and 5, in accordance with the present invention.

In the embodiment illustrated in FIGS. 1-4, sighting notch 80 is defined in a steel rear sight blade and has a sighting notch width of 3 millimeters (mm) and a sighting notch height of 2.91 (mm), providing a notch perimeter that appears to be nearly square, when viewed from the proximal or shooter's eye perspective (e.g., as shown in FIG. 8). A first substantially cylindrical elongate tritium vial, referred to as the left vial 74, is inserted via a vertical bore (best seen in FIGS. 2, 3*b* and in the cross section of FIG. 4*b*) aligned in parallel with the left vertical edge of notch 80.

The vertical bore for left vial 74 has a diameter of 1.6 mm and is intersected by a vertically aligned transverse elongate slot machined into the rear surface of blade 66 to provide a vertical elongate window or opening that makes substantially all of the side of left tritium vial 74 visible from the shooter's perspective, having a vertical extent of 2.5 mm and a horizontal width of at least 1 mm, with semicircular top and bottom window ends. The left edge of the vertical window slot is preferably 4 mm from the outer left edge of sight blade 66 and 2.5 mm from the left edge of sighting notch 80. The upper end of the vertical window slot extends vertically above the bottom of sighting notch 80 by more than 1 mm, so that the radiussed upper end of the window exposing left tritium vial 74 extends well into the space defined by sighting notch 80. Preferably, the radius defining the upper end of the elongate window slot through which the shooter sees left tritium vial 74 is substantially equal to the radius of a substantially circular tritium vial end face carried in the front sight blade (e.g., selected from 18 or 20), as shown in FIG. 8.

Similarly, a second, symmetrical vertical bore for right vial 78 has a diameter of 1.6 mm and is intersected by a vertically aligned transverse elongate slot machined into the rear surface of blade 66 to provide a vertical elongate window or opening that makes substantially all of the side of right tritium vial 78 visible from the shooter's perspective, having a vertical extent of 2.5 mm and a horizontal width of at least 1 mm, with semicircular top and bottom window ends. The left edge of this second vertical window slot is also preferably 4 mm from the outer right edge of sight blade 66 and 2.5 mm from the right edge of sighting notch 80. The upper end of the second or right vertical window slot also extends vertically above the bottom of sighting notch 80 by more than 1 mm, so that the radiussed upper end of the window exposing right tritium vial 78 extends well into the space defined by sighting notch 80. Preferably, the radius defining the upper end of the elongate window slot through which the shooter sees right tritium vial 78 is also substantially equal to the radius of a substantially circular tritium vial end face carried in the front sight blade (e.g., selected from 18 or 20), as shown in FIG. 8.

Beneath notch 80 a third horizontal bore carries horizontal vial 76 has a diameter of 1.6 mm and is intersected by a horizontally aligned transverse elongate slot machined into the rear surface of blade 66 to provide a horizontal elongate window or opening that makes substantially all of the side of horizontal tritium vial 76 visible from the shooter's perspective, having a horizontal extent of 3.5 mm and a vertical height of at least 1 mm, with semicircular left and right window ends. The horizontal window slot is situated to be symmetrically aligned in parallel with the bottom edge of notch 80 and extends beyond the left and right edges of notch 80 by, preferably, one half millimeter on each side, terminating in semicircular ends. The horizontal axis of the elongate horizontal window for horizontal vial 76 is preferably aligned with the radius center for the lower semicircular radiussed ends for the left and right windows, as best seen in the cross section of FIG. 4*b* and FIG. 4*c*.

FIGS. 5*a*-5*e* illustrate five views of a second embodiment 116 of the low-light rear sight assembly with a removable, replaceable rear sight blade 117 having a rear surface 120 textured or machined with anti-glare corrugations 122 and including a U-shaped array of elongate tritium vials 124, 126, 128 defining a U-bracket around rear sight notch 118. FIGS. 6*a*-6*f* illustrate six views of low-light blade 117 with the U-shaped array of elongate tritium vials 124, 126, 128 defining a U-bracket around the rear sight notch 118.

Figure 7D:
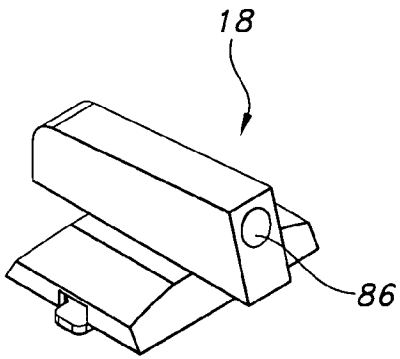
FIGS. 7*a*-7*d* illustrate four views of a low-light front sight blade of FIG. 1 adapted for use with the U-shaped array of elongate tritium vials defining a U-bracket around the rear sight notch of FIGS. 2 and 5, in accordance with the present invention.
Figure 7B:
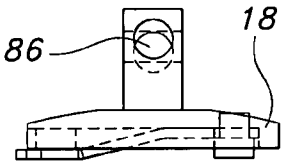
Figure 7C:
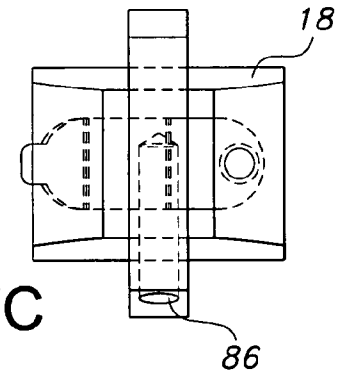
Figure 7A:
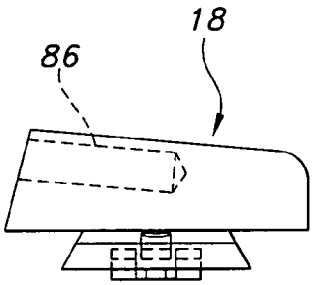

FIGS. 7*a*-7*d* illustrate four views of a low-light front sight blade 18 adapted for use with the U-shaped array of elongate tritium vials defining a U-bracket or "bucket" around the rear sight notch of the embodiments of FIGS. 2 and 5 and includes a cylindrical bore having a rearward facing or proximal opening adapted to receive a cylindrical tritium vial with a circular end face 86 visible to the user, as best seen in FIGS. 7*b*, 7*d* and FIG. 8.

FIG. 8 illustrates a 'shooter's eye' view of the low-light front sight system of FIGS. 1, 2, 3 and 5 showing the instinctive "ball in a bucket" sight alignment method, wherein the "ball" 86 of the front sight (e.g. 18 or 20) is aligned to appear to be inside the "bucket" of the U-bracket around the rear sight notch of FIGS. 2 and 5.

In accordance with the method of the present invention, a rear sight (e.g., 16 or 116) includes a U-shaped array of, preferably, first second and third substantially cylindrical, transparent, tritium vials (e.g., 74, 76, 78) arranged such that the elongated cylindrical side surfaces of the vials are exposed to define an array of elongated illuminated segments. The array is preferably in the shape of a "U" having a first horizontally aligned vial (e.g., 76) positioned below a sight notch (e.g., 80) with a second vertical vial positioned above and to the left of the notch (e.g., 74). A third vertical vial (e.g., 78) is positioned to the right of the sighting notch, above the horizontal vial (e.g., 76). Preferably, the central axes of the left and right vertically aligned vials (e.g., 74, 78) are parallel to one another and parallel to the sighting notch's vertical side walls and are substantially perpendicular to the central axis of the horizontal vial (e.g., 76).

In use, a front blade (e.g., 18) or front post also containing a tritium insert 86 is aligned within the rear sight's U-shaped array of illuminated segments, thereby providing an intuitive sight picture. Shooters are readily trained to use the firearm of the present invention when shooting in low light and in accordance with the method of the present invention, the shooter is simply instructed to "put the ball in the bucket" where the ball, in this instance, represents the front post's round illuminating tritium insert 86 and the "bucket" represents the U-shaped array of illuminating tritium vials surrounding the rear sight notch (e.g., 80).

The firearm 12 of the present invention is particularly well suited for use in configuration with a sight radius relatively short. Pistols, for example typically have a sight radius of between 3 and 10 inches. Tactical shot guns and other firearms used by police forces and military forces also can have a relatively short sight radius, typically between 14 and 20 inches.

The firearm of the present invention 12 is particularly well suited for use in low light and is substantially safer in a firefight when compared to use of tactical flash lights in the like. When confronting a mobile armed subject, it may be undesirable to identify a user's location by attempting to illuminate the target with a flashlight. That flashlight essentially serves as a beacon and gives an armed opponent a target that is easy to find.

In a second embodiment of the present invention, a kit of sights especially adapted for attachment to a firearm can be retrofitted to the firearm thereby adapting that firearm for use in low light. The kit preferably includes a matched set of rear sight and front sight members where the rear sight includes the U shaped array of tritium vials and the front sight includes a tritium insert sized to provide and intuitive sight picture so that, in accordance with the method of the present invention, a shooter can be trained to put the ball in the bucket. Thereby appropriately aligning the front sights tritium insert in the center of the notch within the U shaped array of tritium vials including the rear sight.

In one embodiment, the sight assembly of the present invention is an adjustable rear sight for a pistol, and is also adapted to be received within an oversized dovetail Novak-style notch in the pistol slide, in accordance with standard industry practice.

Broadly speaking, the method of the present invention is a method for aligning an alignable instrument's or firearm's sights in low light environments, and that method includes the following steps:

(a) providing a rear sight assembly (e.g., 16 or 116) including a U-shaped array of, preferably, first second and third substantially cylindrical, transparent, illuminating members (e.g., 76, 74 and 78) arranged such that elongated cylindrical side surfaces of the illuminating members are exposed to a user's view (as best seen in FIGS. 3*a*-3*e*, FIGS. 5*a*-5*e* and FIG. 8); the first, second and third illuminating members define an array of elongated illuminated segments having a first horizontally aligned illuminating member (e.g., 76 or 126) positioned below a sight notch (e.g., 80 or 118) with a second vertical illuminating member positioned above and to the left of the notch; where the rear sight also including a third vertical illuminating member positioned to the right of the sighting notch, above the first vial; wherein the central axis of the third vial is substantially perpendicular to the central axis of the first vial, and substantially parallel with the central axis of the second vial; and a front sight carrying a fourth illuminating member arranged such that a surface of the fourth vial is exposed to a user's view (as shown in FIG. 8). The fourth illuminating member (e.g., 86) being sized to be perceived as fitting within the U-shaped array of the first second and third vials when the front sight is aligned with the rear sight; and (b) aligning firearm 12 so that the front sight illuminating member 86 is seen to fit entirely within a perimeter defined said U-shaped array of said first, second and third illuminating members of said rear sight (e.g., 16 or 116).

Optional color selections can enhance the utility of the sight alignment system of the present invention. In the exemplary embodiments firearm 12 can include a front sight illuminating member 86 that generates light in a selected color (e.g., yellow, green, blue, red, white) matching the light generated by the first, second and third light generating members carried in said rear sight (e.g., 16 or 116), to provide a "ball in a bucket" sight picture wherein the front sight's "ball" 86 matches the color of the rear sight's "bucket". Alternatively, front sight illuminating member 86 can be selected to generate light in a contrasting selected color (e.g., yellow, when the rear sight "bucket" is generating light segments in green, blue, red, or white) to provide a "ball in a bucket" sight picture wherein the front sight's "ball" 86 contrasts with or differs distinguishably from the color of the rear sight's "bucket".

A contrasting color for front sight illuminating member 86 may be useful in ensuring that an excited shooter does not laterally mis-align the sights with the ball beside or outside the bucket.

It will be appreciated by those of skill in the art that the rear sight "notch" (e.g., 80) is, broadly speaking, a passage (in an non-light transmissive or opaque surface) through which light passes, and that the U-shaped array of first, second and third elongate illuminating members or "bucket" is defined in that opaque surface to provide an intuitive alignment method. For purposes of nomenclature, a "notch", is therefore, merely a passage or aperture through which a shooter or user can see the front sight post and the "ball" of illuminating member 86, when practicing the method of the present invention Having described preferred embodiments of a new and improved interchangeable sight system and method, it is believed that other modifications, variations and changes will be suggested to those skilled in the art in view of the teachings set forth herein. It is therefore to be understood that all such variations, modifications and changes are believed to fall within the scope of the present invention as set forth in the claims.

What is claimed is:

1. A firearm adapted for use in low light environments, comprising:

a firearm slide or receiver;

a rear sight carried on said slide or receiver and including a surface defining a notch or aperture surrounded by an array of first, second and third elongated illuminating members arranged such that elongated side surfaces of the illuminating members are exposed to a user's view;

wherein each of said first, second and third elongated illuminated members has an elongated central axis;

said first, second and third illuminating members defining an array of elongated illuminated segments, and having a first horizontally aligned illuminating member positioned below said notch with a second vertical illuminating member positioned above and to the left of said first horizontally aligned illuminating member and to the left of said notch;

said rear sight also including a third vertical illuminating member positioned to the right of said notch, above the first illuminating member;

wherein the central axis of the third illuminating member is substantially perpendicular to the central axis of the first illuminating member, and substantially parallel with the central axis of the second illuminating member; and a front sight carrying a fourth illuminating member arranged on said firearm such that a surface of the fourth illuminating member is exposed to a user's view;

said fourth illuminating member being sized to be perceived as fitting within said array of said first, second and third illuminating members when said front sight is aligned with said rear sight.

2. The firearm for use in low light environments of claim 1, wherein said first, second and third illuminating members comprise substantially cylindrical transparent vials filled with an illuminating material.

3. The firearm for use in low light environments of claim 2, wherein said first, second and third illuminating vials are tritium vials.

4. The firearm for use in low light environments of claim 1, wherein said first, second and third illuminating members comprise light emitting diodes.

5. The firearm for use in low light environments of claim 1, wherein said front sight carrying said fourth illuminating member is arranged such that a substantially circular surface of the fourth illuminating member is exposed to a user's view.

6. The firearm for use in low light environments of claim 1, wherein said fourth illuminating member comprises a transparent vial filled with an illuminating material.

7. The firearm for use in low light environments of claim 6, wherein said fourth illuminating vial is a tritium vial.

8. The firearm for use in low light environments of claim 1, wherein said fourth illuminating member comprises a light emitting diode.

9. The firearm use in low light environments of claim 1, wherein said fourth illuminating member provides light in a selected color.

10. The firearm for use in low light environments of claim 9, wherein said fourth illuminating member's light is in a selected color matching the light generated by said first, second and third light generating members carried in said rear sight, to provide a "ball in a bucket" sight picture wherein the front sight's "ball" matches the color of the rear sight's "bucket".

11. The firearm for use in low light environments of claim 9, wherein said fourth illuminating member's light is in a selected color differing or contrasting the light generated by said first, second and third light generating members carried in said rear sight, to provide a "ball in a bucket" sight picture wherein the front sight's "ball" contrasts with the color of the rear sight's "bucket".

12. An optical alignment apparatus for aligning an instrument or firearm with a point of aim, comprising:

a rear sight defining a notch or aperture surrounded by an array of first, second and third substantially elongated illuminating members arranged such that elongated side surfaces of the illuminating members are exposed to a user's view;

wherein each of said first, second and third elongated illuminated members has an elongated central axis;

said first, second and third illuminating members defining an array of elongated illuminated segments, and having a first substantially horizontal aligned illuminating member positioned below said notch with a second substantially vertical illuminating member positioned above and to the left of said first horizontally aligned illuminating member and to the left of said notch;

said rear sight also including a third substantially vertical illuminating member positioned to the right of said notch, above the first illuminating member;

wherein the central axis of the third illuminating member is substantially perpendicular to the central axis of the first illuminating member, and substantially parallel with the central axis of the second illuminating member; and a front sight spaced from said rear sight and carrying a fourth illuminating member arranged such that a surface of the fourth illuminating member is exposed to a user's view;

said fourth illuminating member being sized to be perceived as fitting within said rear sight's array of said first, second and third illuminating members when aid front sight is aligned with said rear sight.

13. The optical alignment apparatus of claim 12, wherein said first, second and third illuminating members comprise transparent vials filled with an illuminating material.

14. The optical alignment apparatus of claim 13, wherein said first, second and third illuminating vials are tritium vials.

15. The optical alignment apparatus of claim 12, wherein aid first, second and third illuminating members comprise light emitting diodes.

16. The optical alignment apparatus of claim 12, wherein said front sight carrying said fourth illuminating member is arranged such that a substantially circular surface of the fourth illuminating member is exposed to a user's view.

17. The optical alignment apparatus of claim 12, wherein said fourth illuminating member comprises a transparent vial filled with an illuminating material.

18. The optical alignment apparatus of claim 12, wherein said fourth illuminating vial is a tritium vial.

19. The optical alignment apparatus of claim 12, wherein said fourth illuminating member comprises a light emitting diode configured to emit light in a selected color.

* * * * *